United States Patent [19]

Rogers

[11] 4,030,712

[45] June 21, 1977

[54] METHOD AND APPARATUS FOR CIRCULATING A HEAT TREATING GAS

[75] Inventor: Ronald D. Rogers, Rockford, Ill.

[73] Assignee: Alco Standard Corporation, Valley Forge, Pa.

[22] Filed: Feb. 5, 1975

[21] Appl. No.: 547,107

[52] U.S. Cl. ..... 266/252; 148/16.6

[51] Int. Cl.[2] ..... C21D 1/74

[58] Field of Search ..... 148/16, 16.6, 16.7; 206/2 R, 2 A, 5 R, 5 C, 5 E; 432/2; 266/252

[56] References Cited

UNITED STATES PATENTS

| | | | |
|---|---|---|---|
| 2,039,487 | 5/1936 | Lindemuth | 266/5 E |
| 3,796,615 | 3/1974 | Western et al. | 266/5 R X |

FOREIGN PATENTS OR APPLICATIONS

| | | | |
|---|---|---|---|
| 989,610 | 4/1965 | United Kingdom | 266/252 |
| 492,663 | 9/1938 | United Kingdom | 148/16.6 |

*Primary Examiner*—Roy Lake
*Assistant Examiner*—Paul A. Bell
*Attorney, Agent, or Firm*—Leydig, Voit, Osann, Mayer & Holt, Ltd.

[57] ABSTRACT

More uniform heat treating of a work load is achieved by circulating the gas back and forth past the work with a pulsating reciprocating motion while the work is being heated.

7 Claims, 11 Drawing Figures

METHOD AND APPARATUS FOR CIRCULATING A HEAT TREATING GAS

BACKGROUND OF THE INVENTION

This invention relates to a heat treating furnace and to a method of effecting thermochemical processing of a metal work load within a heated furnace chamber in the presence of a gas. Typical examples of gas heat treating processes are carburizing, decarburizing, reduction and nitriding.

In one exemplary process, the furnace chamber is evacuated to a high order of vacuum and then is heated to raise the temperature of the work. Thereafter, an appropriate processing gas is admitted into the chamber and is circulated past the work while the chamber is maintained at a controlled and usually sub-atmospheric pressure and while heating of the work is continued. Upon contacting the hot metal surfaces of the work, the gas decomposes to produce the desired surface characteristics, the gas in the chamber ordinarily being continuously replenished so as to keep a supply of active gas in the chamber.

SUMMARY OF THE INVENTION

The general aim of the present invention is to provide a new and improved furnace and method in which the processing gas is circulated across the work in a unique manner which results in more uniform thermochemical processing of the work surfaces than has been possible heretofore and which, at the same time, enables the effective processing of a comparatively dense work load with a comparatively small volume of gas.

A more detailed object is to achieve the foregoing by circulating the gas past the work with a lively, multi-directional movement, as opposed to substantially unidirectional flow, in order to provide more uniform contact of active gas with all of the work surfaces and to more rapidly remove the gaseous reaction products from the surfaces.

The invention also resides in the provision of novel means for circulating the gas within the chamber and across the work with a back and forth reciprocating motion, and in the controlling of the reciprocating motion to achieve effective circulation across work loads of different shapes.

These and other objects and advantages of the invention will become more apparent from the following detailed description when taken in conjunction with the accompanying drawings.

DETAILED DESCRIPTION OF THE PREFERRED EMBODIMENTS

Figure 1:
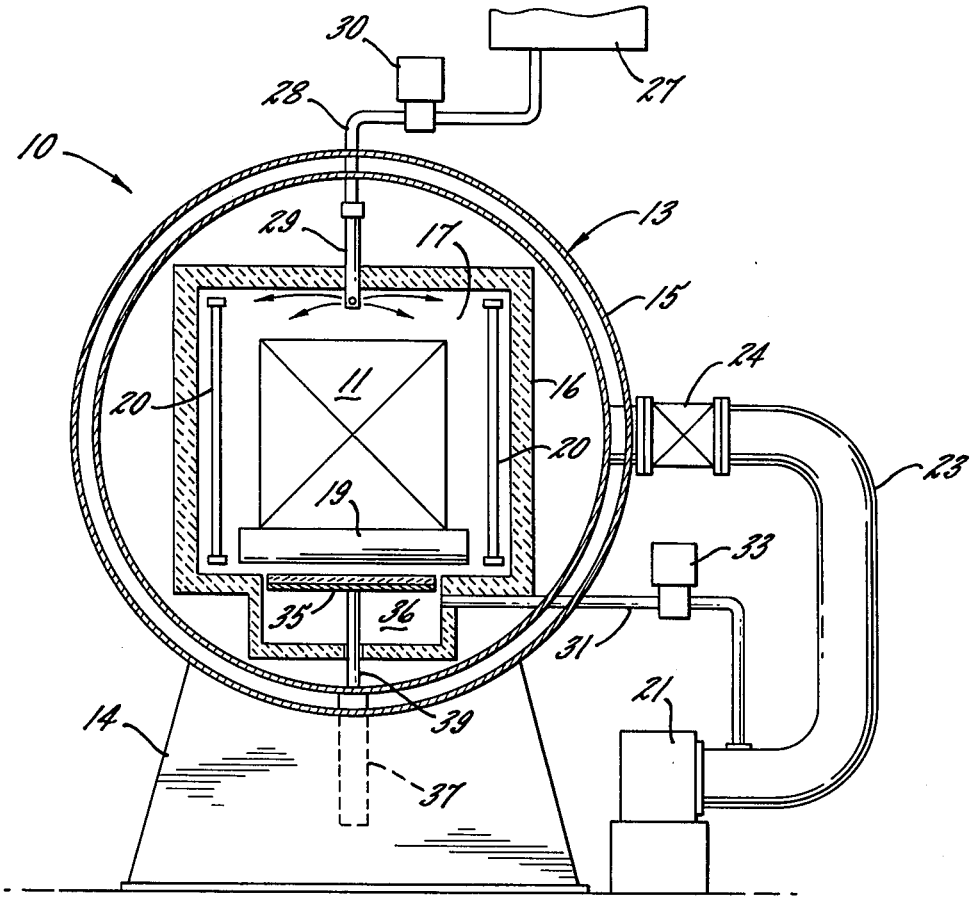
FIG. 1 is a schematic cross-sectional view of a new and improved heat treating furnace capable of carrying out the unique method of the present invention.

The invention is shown in the drawings as embodied in a cold wall vacuum furnace 10 for heat treating a metal work load 11 in the presence of a processing gas which usually is maintained at a sub-atmospheric pressure within the furnace. A furnace of this same general type is disclosed in U.S. Pat. No. 3,171,759.

Briefly, the furnace 10 includes a hollow, cylindrical vessel 13 which is supported on its side by a base 14 and is cooled by a peripheral water jacket 15. Within the vessel is a refractory baffle 16 forming a walled enclosure whose interior defines a heat treating chamber 17 where the work 11 is supported on a roller hearth 19. The work is heated by suitable radiant heating elements 20 which may be of the electrical type and which extend vertically within the chamber.

To evacuate the interior of the vessel 13 and hence the chamber 17, a pump 21 communicates with the interior of the vessel through a conduit 23. A suitable valve 24 may be disposed in the conduit 23 and controlled by a power actuator (not shown) to hold the vacuum in the vessel.

The processing gas is supplied from a suitable source 27 and is admitted into the chamber 17 through a line 28. The latter herein is shown as extending into the top of the vessel 13 and communicating with a graphite gas injector 29 which extends through the top of the baffle 16. Valving indicated generally at 30 is connected into the line to cause the gas to flow into the chamber at a substantially constant rate. Withdrawal of the gas from the chamber is effected through a line 31 located adjacent the bottom of the chamber and communicating with the pump 21 by way of valving 33 which serves to maintain a substantially constant pressure within the chamber.

A furnace 10 of the foregoing character is particularly suitable for use in performing a thermochemical process such as vacuum carburizing in which carbon from a hydrocarbon gas is transferred to the hot metal work surfaces in order to enable case hardening of the work 11. In a typical vacuum carburizing process, the loaded chamber 17 is evacuated to a relatively high order of vacuum and then is heated to subject the work to a brief vacuum conditioning cycle. Thereafter, the chamber is raised to a temperature in the neighborhood of 2,000° F. and then is backfilled through the line 28 with an appropriate gas such as methane ($CH_4$). By way of example, the methane may be admitted continuously into the chamber at the rate of 25 cubic feet per hour and the flow of gas out of the chamber may be regulated so as to maintain the pressure in the chamber at approximately one-eighth atmosphere.

The flow of gas through the chamber is continued after the desired pressure level has been reached. The methane is circulated past the work 11 and decomposes upon contacting the hot work surfaces. The controlling decomposition reaction is:

$$CH_{4(g)} \rightarrow C + 2H_{2(g)}$$

wherein the carbon is absorbed by the hot surfaces and the hydrogen is displaced. To obtain a uniform case depth with a controlled carbon gradient, carbon must be made uniformly available to all of the work surfaces. Accordingly, the gas must be circulated past the work in such a manner as to uniformly replace the hydrogen decomposition product with active methane in the vicinity of all of the work surfaces.

The present invention is based upon my discovery that the surfaces of the work 11 can be treated more uniformly than previously has been possible by circulating the gas across the work surfaces with a lively pulsating, multi-directional motion rather than the conventional unidirectional circulation produced by presently used rotary fans and the like. By circulating the gas back and forth past the work, a supply of active gas is more readily brought into uniform contact with all sides of the work and the gaseous reaction products are more quickly displaced from the work surfaces so as to not only produce a more uniform surface chemistry response but also to allow the processing of denser work with a comparatively small volume of gas.

Figure 2A:
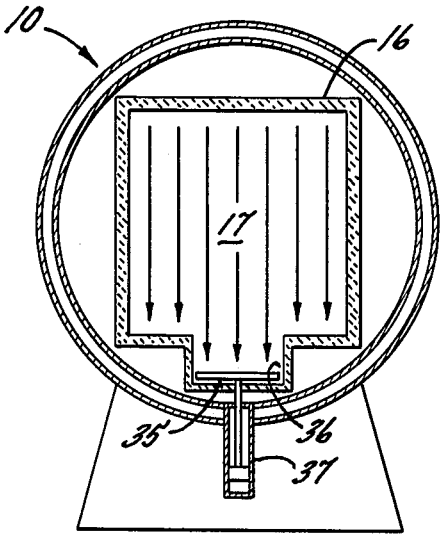
FIGS. 2*a* and 2*b* are cross-sectional views which schematically show the multi-directional gas circulation produced by the furnace shown in FIG. 1.
Figure 2B:
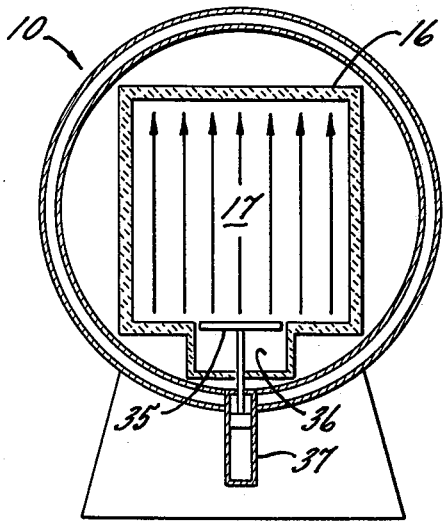

In the preferred manner of carrying out the invention, the gas is circulated past the work 11 with a back and forth reciprocating motion. For this purpose, a plunger 35 covered with heat insulating material is received with a close fit within a cavity or compartment 36 which communicates with the chamber 17 and which herein is shown in FIG. 1 as being located at the lower side of the chamber. An actuator such as a pneumatic cylinder 37 is attached to the underside of the vessel 13 and includes a rod 39 which is connected to the plunger. When the rod 39 is retracted, the plunger 35 is shifted downwardly away from the chamber 17 and draws gas into the compartment 36 to cause the gas to flow downwardly past the work as shown in FIG. 2*a*. Conversely, upward extension of the rod shifts the plunger upwardly out of the compartment and toward the chamber so as to force gas from the compartment and cause the gas to flow upwardly across the work as illustrated in FIG. 2*b*.

With the foregoing arrangement, the gas is admitted continuously into the chamber 17 and may be reciprocated back and forth past the work 11 at a desired frequency and velocity by varying the cycle time and velocity of the plunger 35. By virtue of the back and forth motion imparted to the gas, the gas circulates with various eddying effects and comes into substantially uniform contact with all of the work surfaces. When used in a vacuum conditioned carburizing process, the reciprocating circulation system rapidly replaces the hydrogen with active methane and causes the gas surrounding all of the work surfaces to be of a more uniform nature so as to effect a more uniform case depth. In addition, the system enables the use of smaller quantities of gas to treat a work load of a given size and allows the effective treating of a comparatively large or dense load in a chamber of relatively small volume. The system is effective for pressures ranging from highly negative (e.g., 50 to 100 microns) to highly positive (e.g., at or above atmospheric) and does not rapidly deteriorate under high temperature conditions in the presence of a reactive gas. That is, the plunger 35 may be made of or covered with the same refractory material as the baffle 16 and thus will experience a long service life even though exposed to a hot reactive gas.

Figure 3A:
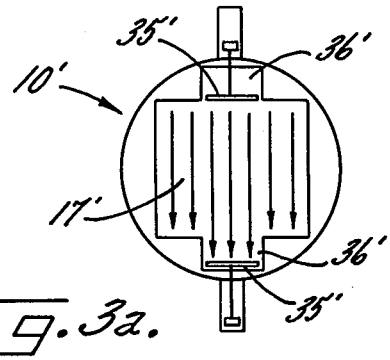
FIGS. 3*a* and 3*b* are views similar to FIGS. 2*a* and 2*b* but schematically show the circulation produced by a modified furnace.
Figure 3B:
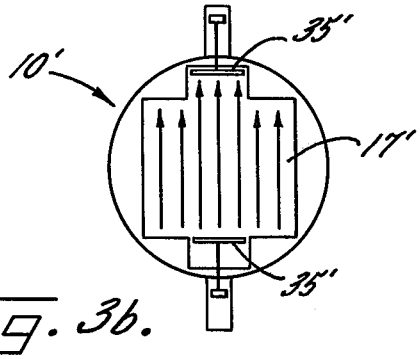
Figure 4A:
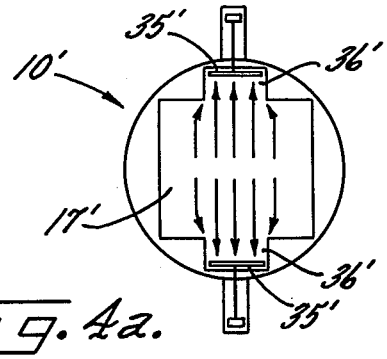
FIGS. 4*a* and 4*b* are views which schematically show an alternate method of operating the furnace shown in FIGS. 3*a* and 3*b*.
Figure 4B:
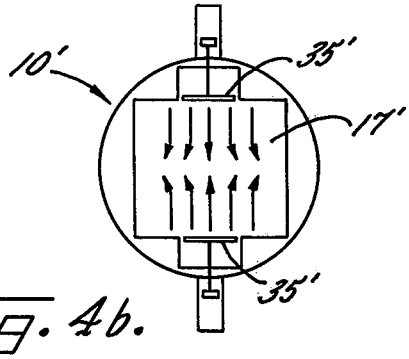
Figure 5A:
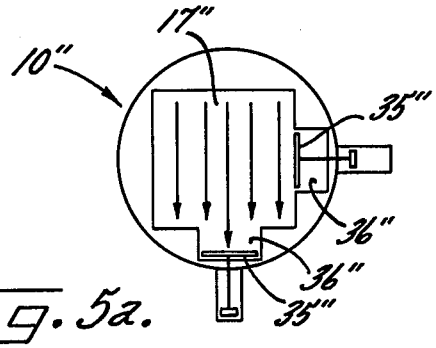
FIGS. 5*a* to 5*d* are cross-sectional views which schematically show the circulation produced by still another embodiment of a furnace incorporating the features of the invention.
Figure 5B:
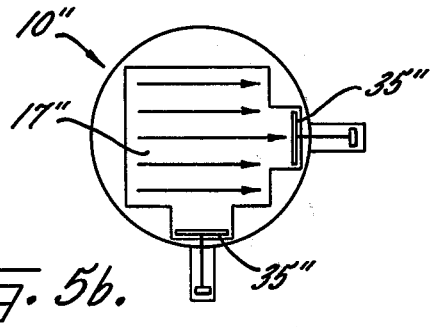
Figure 5C:
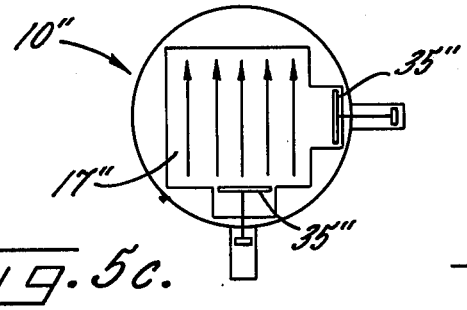
Figure 5D:
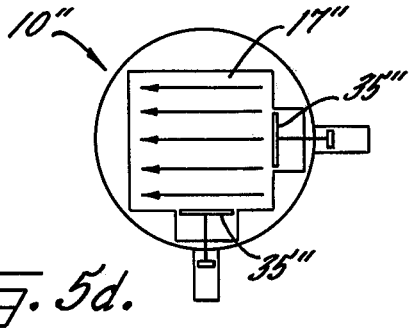

The furnace 10' shown in FIGS. 3*a*, 3*b* and 4*a*, 4*b* is identical to the furnace 10 except that reciprocating plungers 35' are provided in compartments 36' located at both the upper and lower sides of the chamber 17'. As shown in FIGS. 3*a* and 3*b*, the plungers 35' can be reciprocated in unison but in the same direction whereby one plunger moves toward the chamber 17' while the other moves away from the chamber, and vice versa, thereby to effect substantially bi-directional circulation by drawing gas into one compartment 36' while forcing gas from the other compartment. Alternatively, a more random multi-directional circulation may be effected by operating the plungers 35' as shown in FIGS. 4*a* and 4*b* wherein the plungers are reciprocated in unison but in opposite directions so as to simultaneously draw gas into both compartments 36' and then simultaneously force gas from both compartments.

In FIGS. 5*a* to 5*d*, there is shown a furnace 10'' in which one plunger 35'' is located in a compartment 36'' at one side of the chamber 17'' while an additional plunger 35'' is disposed at right angles to the plunger and is located in a second compartment 36''. By operating the plungers in various sequences, the gas can be circulated in several patterns so as to best be brought into contact with irregularly shaped workpieces whose surfaces otherwise might not be effectively reached by simple back and forth circulation. One exemplary sequence is shown in FIGS. 5*a* to 5*d* wherein a complete cycle involves forcing the gas downwardly, then to the right, back upwardly and then to the left.

I claim:

1. A heat treating furnace having a walled enclosure defining a heating chamber, heating elements within the chamber for heating a work load disposed in the chamber, means including an inlet for admitting a substantially continuous flow of processing gas into said chamber, means including an outlet for exhausting a substantially continuous flow of gas from said chamber, and power-operated means for repeatedly increasing and decreasing the effective volume of said chamber and for imparting a back and forth pulsating motion to the gas while the gas is within said chamber and is flowing from said inlet to said outlet thereby to circulate the gas back and forth within the chamber and past the work load with a pulsating action as the gas flows from said inlet to said outlet.

2. A heat treating furnace having a walled enclosure defining a heating chamber, heating elements within said chamber for heating a work load disposed in the chamber, means for admitting a processing gas into said chamber, a compartment communicating with said chamber, a plunger mounted within said compartment to move toward and away from said chamber, and means for reciprocating said plunger within said compartment whereby the plunger sucks gas toward said compartment when moved away from said chamber and expels gas away from said compartment when moved toward said chamber so as to circulate the gas across the work load with a reciprocating action.

3. A heat treating furnace as defined in claim 2 further including an additional compartment communicating with said chamber, an additional plunger mounted within said additional compartment to move toward and away from said chamber, and means for reciprocating said additional plunger within said additional compartment.

4. A heat treating furnace as defined in claim 3 in which said one plunger and said additional plunger are located at opposite sides of said chamber.

5. A heat treating furnace as defined in claim 4 in which said means reciprocate said plungers in unison and in the same direction whereby one plunger moves toward said chamber while the other plunger moves away from said chamber and vice versa.

6. A heat treating furnace as defined in claim 4 in which said means reciprocate said plungers in unison but in opposite directions whereby the plungers simultaneously move toward said chamber and simultaneously move away from said chamber.

7. A heat treating furnace as defined in claim 3 in which said one plunger and said additional plunger are disposed at substantially right angles to one another.

* * * * *